US005544450A

United States Patent [19]

Schmidt et al.

[11] Patent Number: 5,544,450

[45] Date of Patent: Aug. 13, 1996

[54] DOUBLE-HUNG TILTING SASH TYPE WINDOW SYSTEM

[75] Inventors: Melvin J. Schmidt, Lakeland, Minn.; Thomas P. Coach, Osceola, Wis.; Glenn C. Hause, Woodbury, Minn.; Dennis A. Galowitz, Stillwater, Minn.; James P. Wyman, White Bear Lake, Minn.; Robert A. Hendricks, New Richmond, Wis.; Lawrence J. Ver Steeg, Sioux Falls, S. Dak.; Harold H. Evans, Hudson, Wis.

[73] Assignee: Andersen Corporation, Bayport, Minn.

[21] Appl. No.: 927,204

[22] Filed: Aug. 7, 1992

Related U.S. Application Data

[63] Continuation-in-part of Ser. No. 903,368, Jun. 24, 1992, Pat. No. 5,243,783.

[51] Int. Cl.[6] ..... E05D 13/00

[52] U.S. Cl. ..... 49/419; 49/453

[58] Field of Search ..... 49/428, 419, 414, 49/453, 403, 181, 176

[56] References Cited

U.S. PATENT DOCUMENTS

| | | | |
|---|---|---|---|
| 2,720,682 | 10/1955 | Perry . | |
| 2,731,287 | 1/1956 | Haynes . | |
| 2,883,226 | 4/1959 | Haynes . | |
| 3,055,062 | 9/1962 | Peters et al. . | |
| 3,195,174 | 7/1965 | Nobes . | |
| 3,377,747 | 4/1968 | Donkin . | |
| 3,399,490 | 9/1968 | Hettinger . | |
| 3,434,236 | 3/1969 | Weidner et al. . | |
| 3,524,282 | 8/1970 | Kraft et al. . | |
| 3,676,956 | 7/1972 | Taylor et al. . | |
| 3,797,168 | 3/1974 | Trout . | |
| 3,842,540 | 10/1974 | Anderson . | |
| 3,844,066 | 10/1974 | Nobes . | |
| 4,034,510 | 7/1977 | Huelsekopf | 49/419 |
| 4,068,406 | 1/1978 | Wood . | |
| 4,079,549 | 3/1978 | Wood . | |
| 4,115,973 | 9/1978 | Anderson . | |
| 4,137,671 | 2/1979 | Miller . | |
| 4,226,050 | 10/1980 | Kessler . | |
| 4,363,190 | 12/1982 | Anderson . | |
| 4,364,199 | 12/1982 | Johnson et al. . | |
| 4,452,012 | 6/1984 | Deal . | |
| 4,590,708 | 5/1986 | Campodonico . | |
| 4,610,108 | 9/1986 | Marshik . | |
| 4,674,246 | 6/1987 | Giguere | 49/419 X |

(List continued on next page.)

FOREIGN PATENT DOCUMENTS

| | | | |
|---|---|---|---|
| 1025833 | 4/1966 | United Kingdom | 49/419 |
| 2121099 | 12/1983 | United Kingdom . | |
| 2247907 | 3/1992 | United Kingdom . | |

*Primary Examiner*—Jerry Redman

*Attorney, Agent, or Firm*—Merchant, Gould, Smith, Edell, Welter & Schmidt, P.A.

[57] ABSTRACT

A window having a frame with at least two oppositely disposed side members, a top member, and a bottom member. Operably connected to each frame side member is a jamb liner having a front face and at least one jamb channel. Mounted within the frame is at least one sash having two oppositely disposed sides. The sash tilts away from the frame for easy cleaning. Within each jamb channel is a locking slide block for slidably and rotatably mounting the sash to the frame. A plough extends from the face of each jamb liner in the direction of the opposite frame side member. Each side of the sash has a sash groove for slidably mounting the sash in the frame by receiving adjacent ploughs. The plough and sash grooves have interlocking edges which engage to resist unintentional tilting of the sash. The jamb liner is mounted for lateral displacement from a first position wherein the plough is engaged with a sash groove to a second position wherein the plough is at least partially retracted from the groove so that the window can be tilted. There is a counterbalance operatively connected to the frame which has a counterbalance tab with an elongated portion having a flange proximate one end for connecting the counterbalance to the locking slide block.

16 Claims, 17 Drawing Sheets

U.S. PATENT DOCUMENTS

| | | | |
|---|---|---|---|
| 4,683,676 | 8/1987 | Sterner, Jr. . | |
| 4,718,194 | 1/1988 | FitzGibbon et al. . | |
| 4,799,333 | 1/1989 | Westfall et al. . | |
| 4,813,180 | 3/1989 | Scalzi . | |
| 4,916,863 | 4/1990 | Burrow et al. | 49/419 |
| 4,922,657 | 5/1990 | Foss . | |
| 4,941,285 | 7/1990 | Westfall . | |
| 4,958,462 | 9/1990 | Cross . | |
| 4,993,188 | 2/1991 | Erickson et al. | 49/419 |
| 5,077,939 | 1/1992 | Erickson . | |
| 5,199,219 | 4/1993 | Martini et al. | 49/428 |

FIG. 15
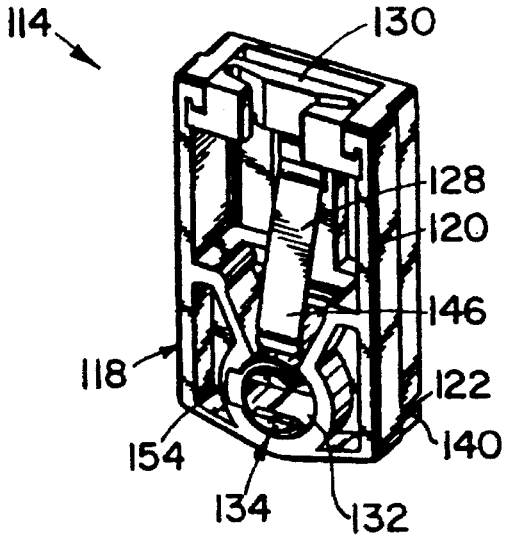
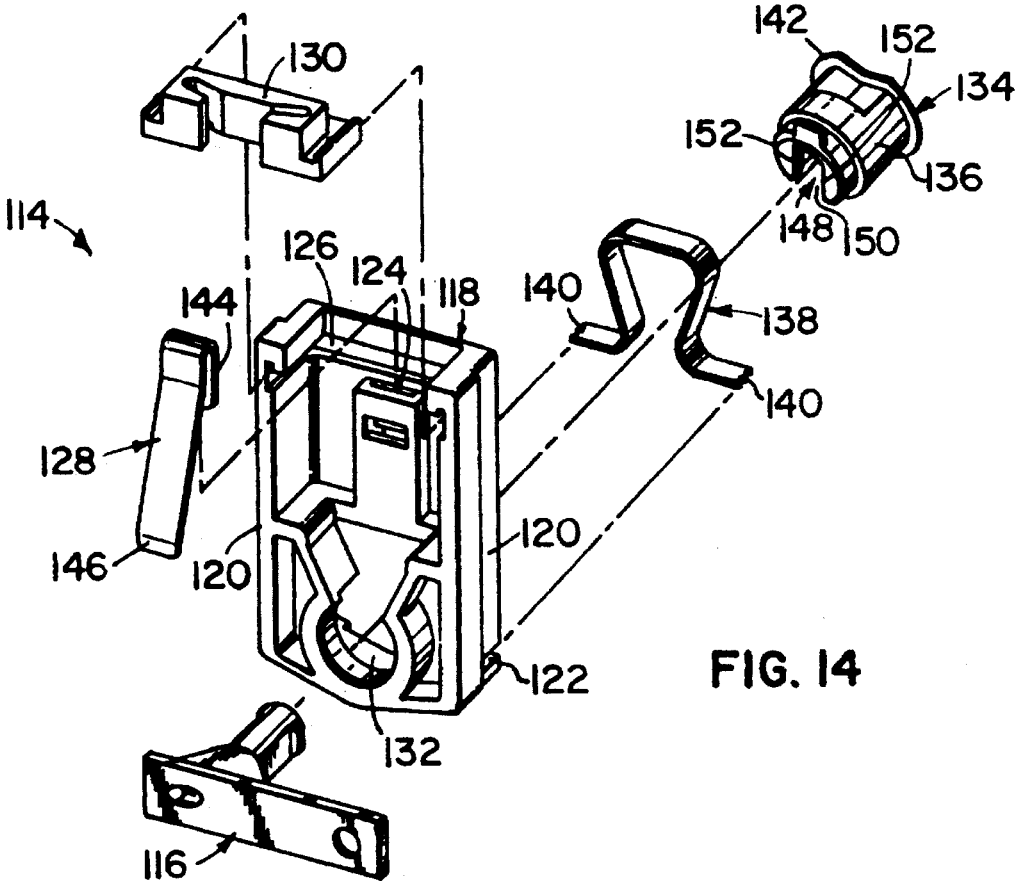
FIG. 14

DOUBLE-HUNG TILTING SASH TYPE WINDOW SYSTEM

This application is a continuation-in-part of Ser. No. 903,368, filed Jun. 24, 1992, now U.S. Pat. No. 5,243,785 entitled LOCKING SLIDE BLOCK.

FIELD OF THE INVENTION

This invention generally relates to a tilting sash type window system designed for easy cleaning, structural integrity, and safety.

BACKGROUND OF THE INVENTION

Double-hung tilting sash type windows have become increasing popular. Much of this popularity is due to the tilting sash feature which allows both inside and outside surfaces of the window to be cleaned from the inside. A reoccurring problem with tilting sash type windows is how to achieve a tight seal between window frame and sashes without making it difficult to tilt the sashes. Additionally, the structural integrity of the window must be maintained at a sufficiently high level and unexpected motion of the sash must be reduced to promote safety. In the past, frames have been equipped with jamb liners having ridges, or ploughs, which extend into grooves in the side of the sashes.

One such configuration is shown in FIG. 2 of U.S. Pat. No. 4,799,333 to Westfall et al. In Westfall, these ploughs have outwardly disposed sides approximately perpendicular to the front face of the jamb liner. A similar arrangement is shown in FIG. 5 of U.S. Pat. No. 4,922,657 to Foss. The plough configuration of the jamb liner disclosed by Westfall et al. and Foss, however, do not project outwardly to engage with sashes having grooves with inward projections.

Tilting sash windows have also been equipped with locking slide blocks, such as the one disclosed in U.S. Pat. No. 4,610,108 to Marshik. Marshik discloses a double-hung window having a frame with a set of parallel jamb channels on opposite sides of the frame. Within each jamb channel is a slidably mounted locking block. A spring counterbalance mechanism is attached to a plate on each block. A pivot extends from proximate the lower end of opposite sides of each sash into locking cams housed within the block. The pivot allows the sash, which holds a window pane, to be rotated or tilted inward. As the pivot rotates, the cam forces serrated ends of a spring into opposite sides of the jamb channel to prevent the counterbalance spring from pulling up the blocks and sash while cleaning.

U.S. Pat. No. 4,813,180 to Scalzi discloses another locking sliding block for double-hung windows. Like the '108 patent, a locking block is slidably mounted within jamb channels and a pivot extends from opposite sides of the sash into a pivot button, or cam, in each locking block. Unlike the '108 patent, however, the pivot has a slot which engages a retaining ridge in the pivot button. This is intended to prevent dislocation of the pivots during transport and installation of the window due to deflection or bowing of the frame away from the sash. The locking block disclosed by Scalzi, although allowing the sash to pivot inside for easy cleaning of the window pane, does not allow the window to be conveniently removed from the inside.

SUMMARY OF THE INVENTION

The present invention is a design for cleaning tilting sash type windows having an inside and an outside including a frame having at least two oppositely disposed side members, a top member, and a bottom member. Approximately parallel and operably connected to each side member is a jamb liner having a front face and two jamb channels.

The window has two sashes, each with oppositely disposed sides. The sashes are slidably mounted in the frame and have a tilted position and an untilted position. When the sash is in the untilted position, the two sash sides are parallel and proximate opposite side members of the frame.

A plough extends from the face of each jamb liner in the direction of the opposite side member. The plough has an inside facing side and an outside facing side, wherein the outside facing side has a projecting portion extending generally in the direction of the outside of the window.

Each side of the sash has a sash groove for slidably mounting the sash in the frame by receiving adjacent ploughs when the sash is in the untilted position. The groove has a generally inside facing side and a generally outside facing side, wherein the inside facing side has a projecting portion projecting generally in the direction of the inside of the window. The projecting portion of the plough engages with the projecting portion of the groove to resist inward displacement of the sash when the sash is in the untilted position. This is especially important for resisting unwanted tilting by wind force on the outside of the window.

In order to disengage the ploughs from the sash groove, the jamb liner is mounted for lateral displacement from a first position wherein the plough is engaged with the sash groove to a second position wherein the plough is at least partially retracted from the groove. To move the jamb liner from the first position to the second position, the window has a wash-assist.

A locking slide block is slidably mounted within each jamb channel for slidably and rotatably mounting the sashes to the frame. The locking slide block has a housing with oppositely disposed sliding surfaces for guiding the housing in the jamb channel. Within the block is a locking spring with serrated ends for selectively engaging oppositely disposed sides of the jamb channel to lock the block in a fixed position. A rotary cam having a rotational axis is carried within the housing of the block. The cam has camming surfaces which come into contact with the locking spring to force the serrated ends of the locking spring into engagement with the sides of the jamb channel.

One sash pivot is disposed on each lower opposite side of the sashes for operably connecting the sashes to the cam. The pivot has a longitudinal axis. Proximate one end of each pivot are oppositely disposed flanges extending perpendicularly away from the longitudinal axis. The cam has a sash pivot opening with one open top slot for inserting or removing the sash pivot. The cam also has oppositely disposed flanges extending perpendicularly to the cam's rotational axis into the sash pivot opening. When the pivot is in the pivot opening of the cam, the pivot flanges engage the cam flanges so that the pivot cannot be pulled out of the pivot opening in a direction approximately parallel to the longitudinal axis of the pivot.

The locking slide block also has a sash pivot retainer spring having a first end operably connected to the housing and a free end proximate the cam. The spring has a depressible first position for allowing the sash pivot to be inserted or removed from the sash pivot opening through the open top slot. The spring also has a second and normal position for preventing removal of the sash pivot through the open top slot.

A counterbalance is operably connected to jamb liner. The counterbalance has a counterbalance tab which includes an elongated portion having a flange proximate the end opposite the counterbalance for connecting the counterbalance to the sliding locking block.

These advantages and other objectives obtained with this invention are further explained hereinafter with more particularity and by reference to the preferred embodiment as shown in the following drawings.

BRIEF DESCRIPTION OF THE DRAWINGS

FIG. 14 shows an exploded perspective view of a sliding locking block with a pivot;

FIG. 15 shows the assembled sliding locking block without pivot;

DETAILED DESCRIPTION OF THE PREFERRED EMBODIMENT

Figure 1:
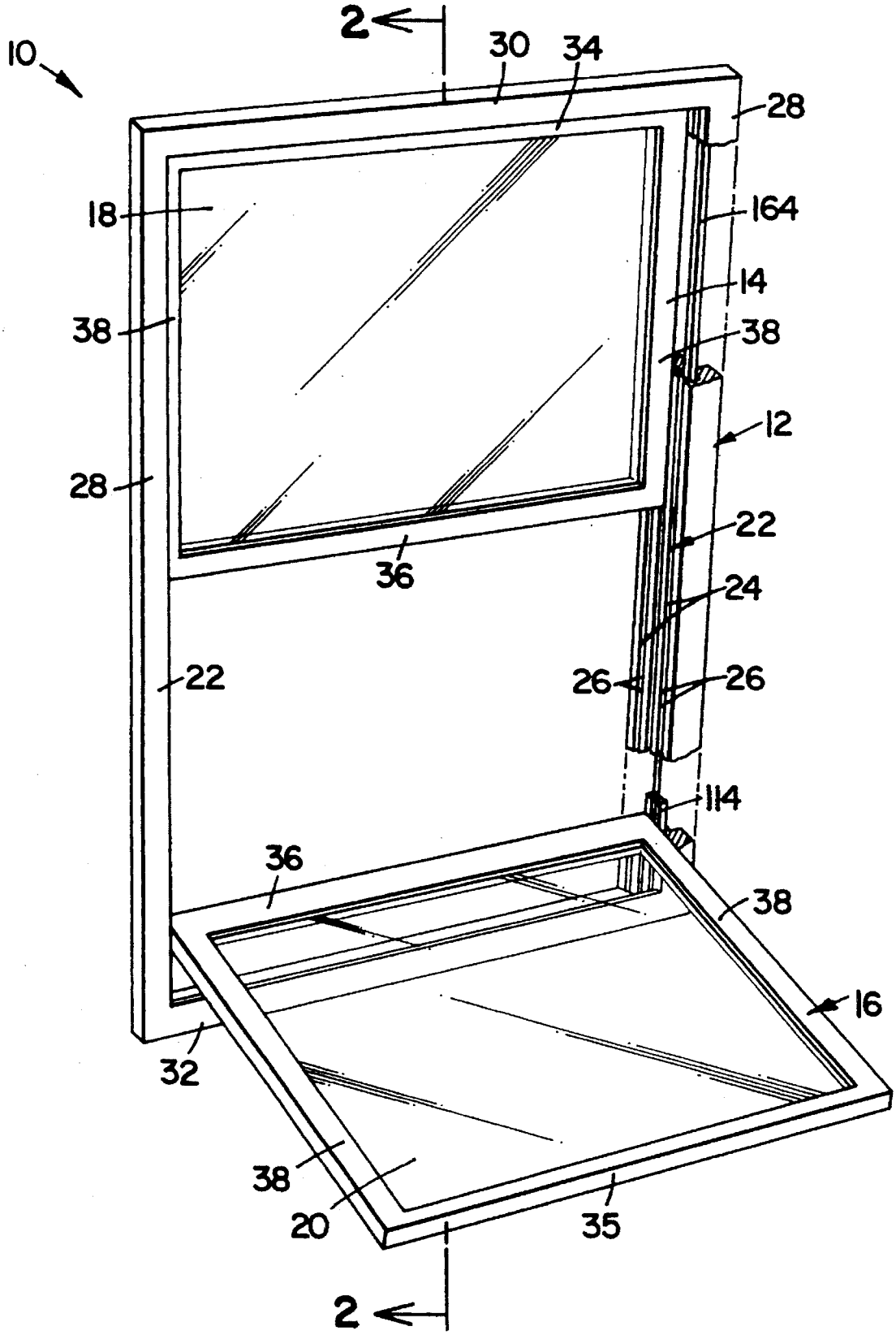
FIG. 1 shows a perspective view of the window in accordance with the present invention.

Referring now to the drawings, wherein like referenced numerals designate identical or corresponding parts throughout the several views, FIG. 1 shows a double-hung tilting sash window 10. The window 10 has a frame 12 supporting upper sash 14 and lower sash 16, each sash having window panes 18 and 20, respectively. The frame 12 also has two oppositely disposed jamb liners 22. Each jamb liner has two jamb channels 24 and each jamb channel 24 has two ploughs 26.

Jamb liners 22 are mounted for lateral movement away from the proximate sides of sashes 14 and 16. This lateral displacement of jamb liners 22 is accomplished with the aid of a means for laterally displacing the jamb liners which includes either a wash-assist ramp, hooked wash-assist, camming wash-assist, or biased wash-assist ramp, discussed in detail below.

Within each jamb channel 24 is at least one counterbalance 164 operably connected to a sliding locking block 114. The counterbalances are preferably located in an upper end of each jamb channel 24 proximate upper sash 14, as shown in FIG. 1. Each locking slide block is pivotably connected to a lower end of opposite sides of each sash 14 and 16.

Frame 12 has two oppositely disposed side members 28, a top member 30, and a bottom member 32 all operably connected by means well known in the art. Window 10 and frame 12 have an inside, facing in FIG. 1, and an outside which is disposed opposite the inside. Upper sash 14 has an upper check rail 34 and a bottom rail 36. Lower sash 16 has a lower check rail 35 and a bottom rail 36. Disposed on opposite sides of each sash 14 and 16 are stiles 38.

Figure 2:
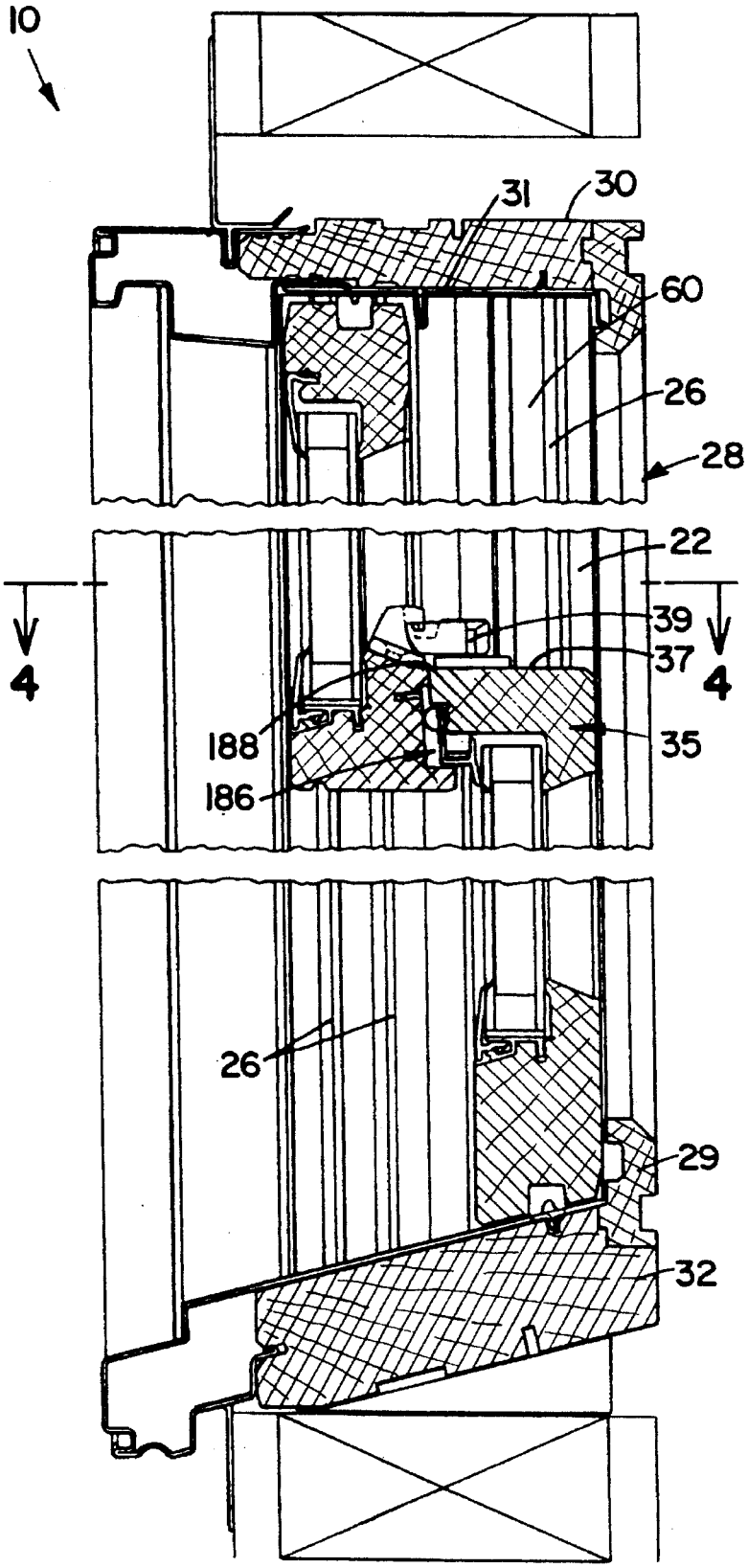
FIG. 2 shows a vertical cross-section of the window in accordance with the present invention.

FIG. 2 shows a vertical cross-section of window 10 with the outside of window 10 shown on the left and the inside of window 10 shown on the right. FIG. 2 also shows a frame side member 28, frame top member 30 with longitudinal flange 31 operably connected, and frame bottom member 32. Extending vertically from bottom member 32 is a stop 29. Jamb liner 22 is shown mounted to frame side member 28. Ploughs 26 are also shown. Sashes 14 and 16 are locked with a latch 39 well known in the art.

FIG. 2 also shows a check rail liner pad 186 connected to jamb liner 22. Liner pad 186 is preferably positioned so that a top edge 188 is proximate a top edge 37 of lower check rail 35, as shown in FIG. 2.

Figure 3:
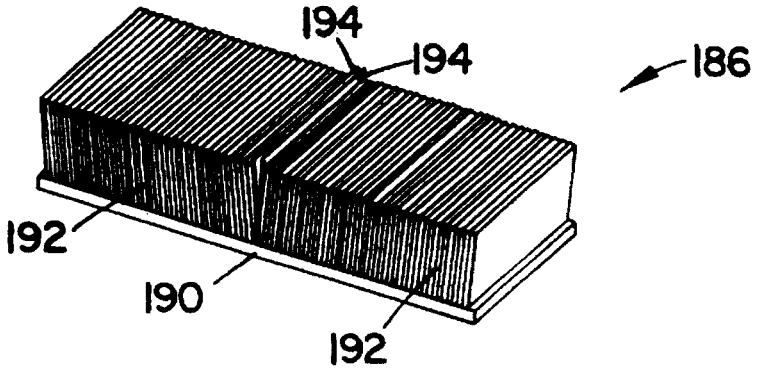
FIG. 3 shows a perspective view of a check rail liner pad.

FIG. 3 shows a perspective view of liner pad 186 having a base 190. Extending from the base 190 are two sections of pile 192 separated by two projecting fins 194. Pile 192 is preferably polypropylene-siliconed. Fins 194 are preferably polypropylene and extend above pile 192, as shown.

Figure 4:
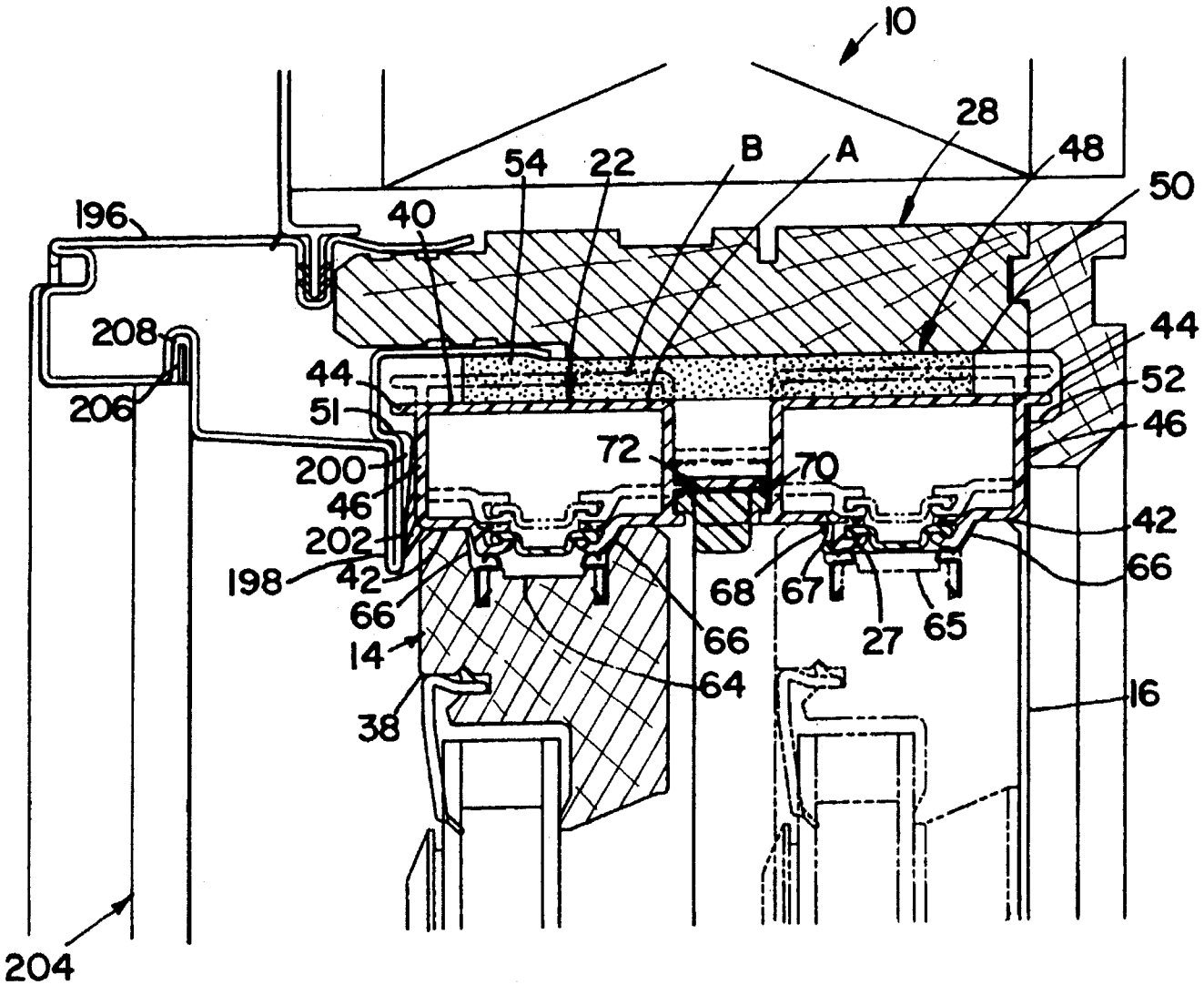
FIG. 4 shows a partial horizontal cross-section of the window.

FIG. 4 is a horizonal cross-section of window 10 as shown in FIG. 2. The outside of window 10 is to the left and the inside of window 10 is to the right of FIG. 4. Jamb liner 22 is shown mounted for lateral displacement in frame side member 28. Jamb liner 22 has a back 40 and front face 42. Back 40 of jamb liner 22 includes jamb liner tabs 44 extending laterally beyond jamb liner sides 46.

A vertical jamb liner mount 48 operably connected to member 28 is defined by a back side 50 opposite a mount rail 51 and a mount rail 52. As shown in FIG. 4, in the preferred embodiment there is an open cell foam spring 54 between back 50 of jamb liner mount 48 and back 40 of jamb liner 22. Foam spring 54 is adhered to jamb liner 22 by hot-melt adhesive, or staples, or other suitable means. In the preferred embodiment, the foam is preferably polyurethane. Metal or plastic springs could be substituted for foam spring 54. Compression of spring 54 allows jamb liner 22 to be laterally displaced from a first position A to a second position B shown in dashed lines.

Figure 6:
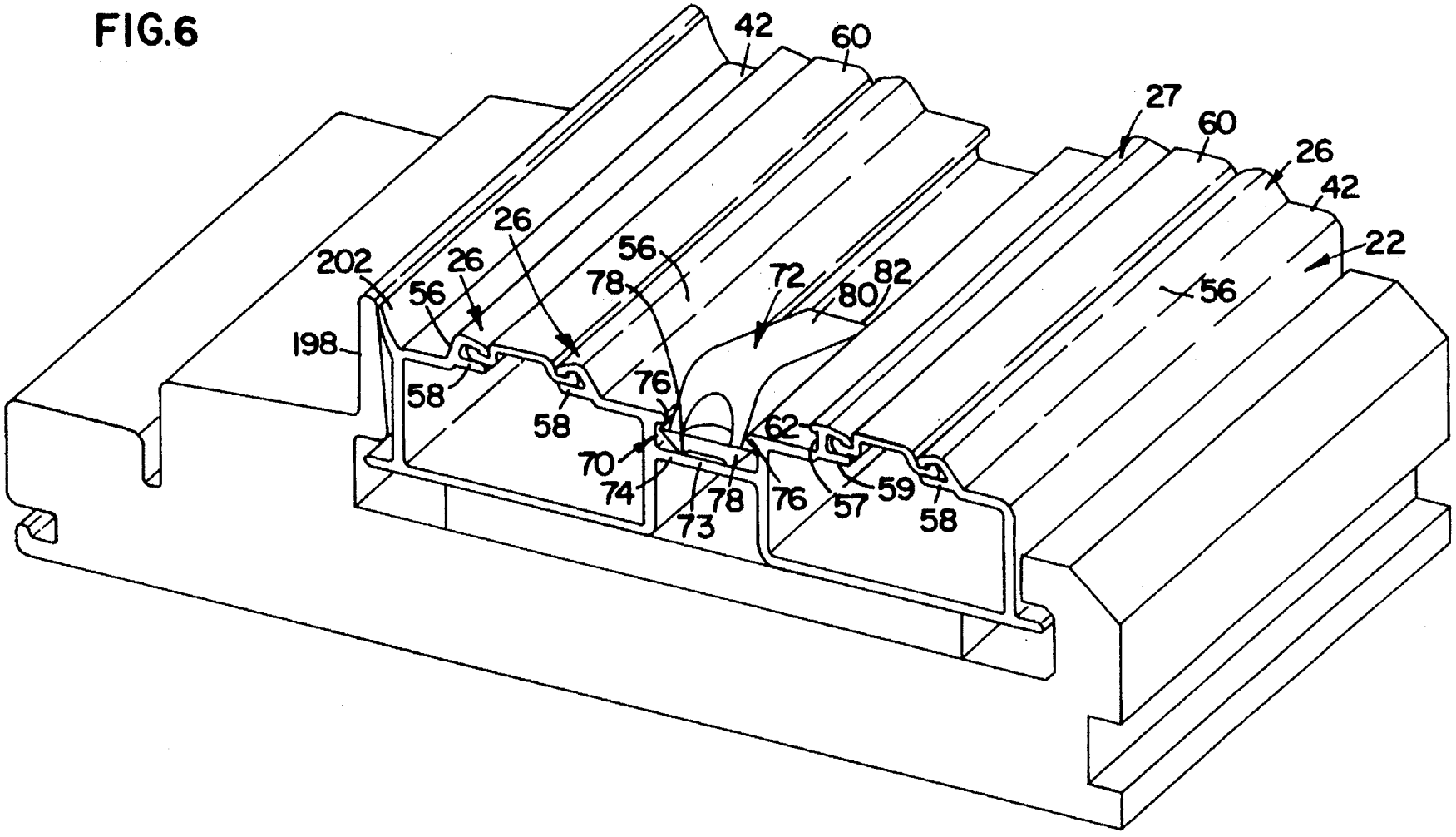
FIG. 6 is a perspective view of a side member with jamb channel and wash-assist ramp.

As shown in FIG. 6, projecting from front face 42 of jamb liner 22 are ploughs 26 and a ribbed plough 27. Each plough 26 has a back side 56 and a front side 58. Each front side 58 has a C-shaped channel for holding a counterbalance cover 60. Counterbalance covers 60 extend from the top of jamb liner 22 down to proximate the top of check rail 35 of lower sash 16 (as shown in FIG. 2). Back sides 56 of ploughs 26 generally slope away from front face 42 of jamb liner 22 at an angle greater than 90°, except the plough 27 proximate the outside of lower sash 16. A back side 57 of plough 27 preferably projects at an angle less than or equal to 90° away from front face 42. This angle is preferably 87°. Back side 57 has a first end proximate front face 42 and a second end. Connected to the second end of back side 57 is a wedge-shaped projecting portion 62 which extends generally in the direction of the outside of window 10. Ribbed plough 27 also has a front side 59 having a c-shaped channel for holding counterbalance cover 60.

Also shown in FIG. 4 are sash grooves 64 and 65 which extend vertically along the sides of sashes 14 and 16, respectively, through bottom check rails 36, styles 38 and check rails 34 and 35, respectively. Sash groove 64 is sized to receive ploughs 26 and sash groove 65 is sized to receive plough 26 and plough 27. Sash grooves 64 and 65 have sides 66 generally conforming to the back sides 56 of ploughs 26. Sash groove 65, however, has an inward facing side 67 with an inwardly projecting portion 68. Inwardly projecting portion 68 need only be in lower check rail 35 of sash groove 65 of lower sash 16 in order to resist unwanted tilting of sash 16.

Also shown in FIG. 4 is a metal outer frame member 196 having a sash retaining rib 198. Sash retaining rib 198 extends away from frame side member 28 at approximately 90° to a point where rib 198 at least partially overlaps stile 38 of upper sash 14. Sash retaining rib 198 has a vinyl bead 200 disposed inward. A flexible seal 202 connected to jamb liner 22 extends generally outward until engaging rib 198. Seal 202 is preferably flexible vinyl having a hardness (durometer A+/−3) of 72. Jamb liners 22 are preferably rigid vinyl having a hardness (durometer D+/−3) of 82.

FIG. 4 also shows a screen 204 installed on the outside of window 10. The screen 204 is held in place by the insertion of retractable tab 206 in channel 208 of outer frame member 196.

As also shown in FIG. 4, between jamb channels 24 of jamb liner 22 is a vertical channel 70 with a wash-assist ramp 72 slidably mounted therein. This feature will be discussed in greater detail below.

Figure 5:
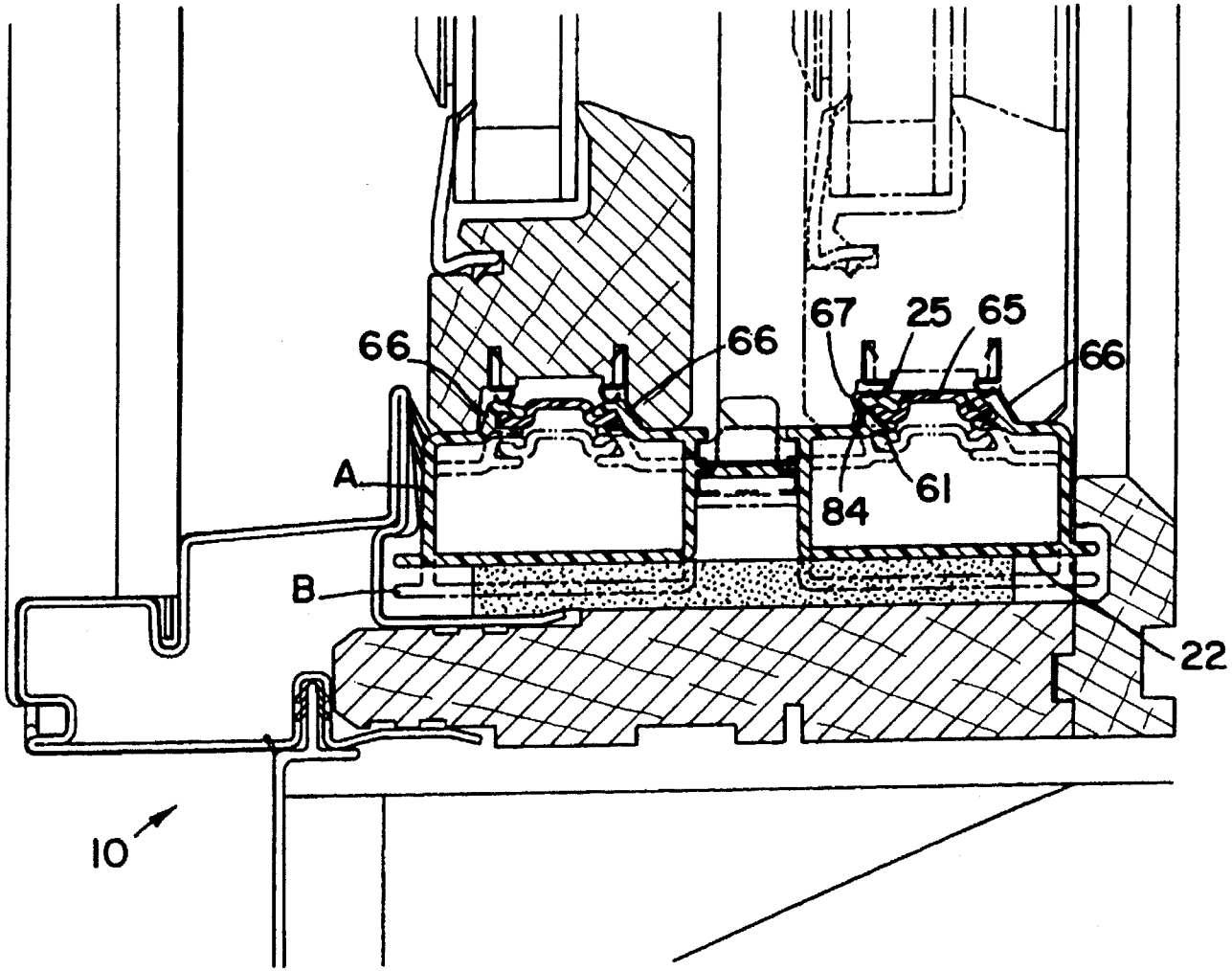
FIG. 5 shows a partial horizontal cross-section showing an alternative embodiment of the window.
Figure 8:
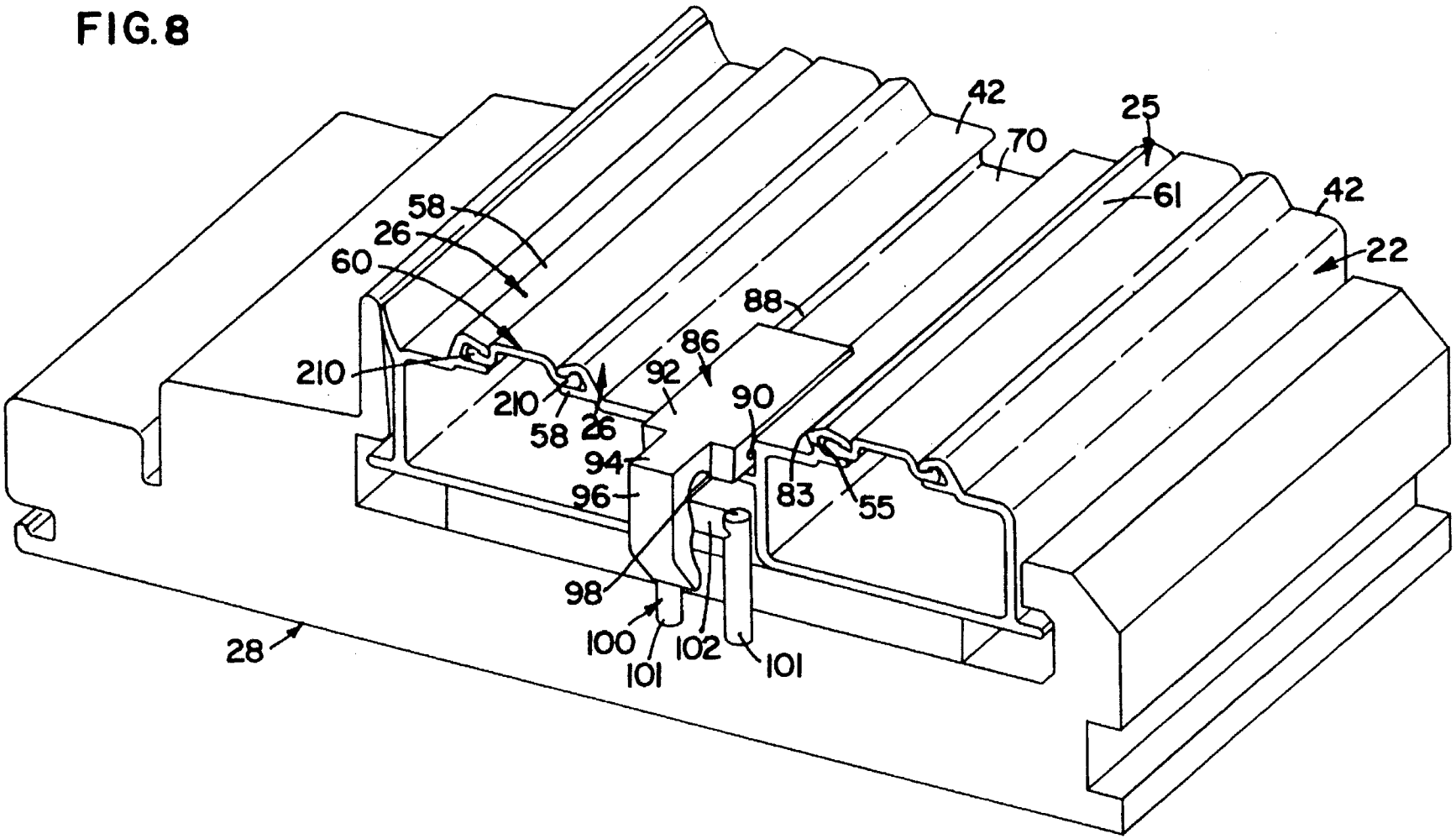
FIG. 8 shows a perspective view of the side member and jamb liner with a hooked wash-assist.

FIG. 5 shows a partial horizontal cross section of window 10 with the outside of window 10 to the left and the inside of window 10 to the right of FIG. 5. Sash groove sides 66 and 67 are essentially the same as shown in FIG. 4. An inverted plough 25 is proximate the outside of lower sash 16. The inverted plough 25 is an alternative embodiment to the ribbed plough 27. Plough 25 has a c-shaped front side 61. Plough 25 extends away from front face 42, as shown in FIG. 8, of jamb liner 22 at an acute angle so that a back side 55 of this plough 25 forms a projecting portion, projecting in the direction of the outside of the window. The sash groove side 67 proximate this plough 25 has a projecting portion 84, as shown in FIG. 5, which engages with the outwardly projecting portion 83 of back side 55, as shown in FIG. 8. Projecting portion 84 need only be in lower check rail 35 of sash groove 65 of lower sash 16 in order to resist unwanted tilting of sash 16.

FIG. 6 is a perspective view of a portion of the cross-section shown in FIG. 4. Wash-assist ramp 72 is shown with base 73 riding in channel 70 of jamb liner 22. Channel 70 has a back 74 and rails 76 extending from front face 42 of jamb liner 22. Extending from base 73 of ramp 72 are two outwardly disposed ridges 78 that are disposed laterally on opposite sides of wash-assist ramp 72 to engage with rails 76 to hold wash-assist ramp 72 within channel 70. A ramp portion 80 of wash-assist ramp 72 extends from base 73 and away from jamb liner 22 beyond front face 42. A toe 82 of ramp portion 80 remains between back 74 and rails 76 of channel 70.

Figure 7A:
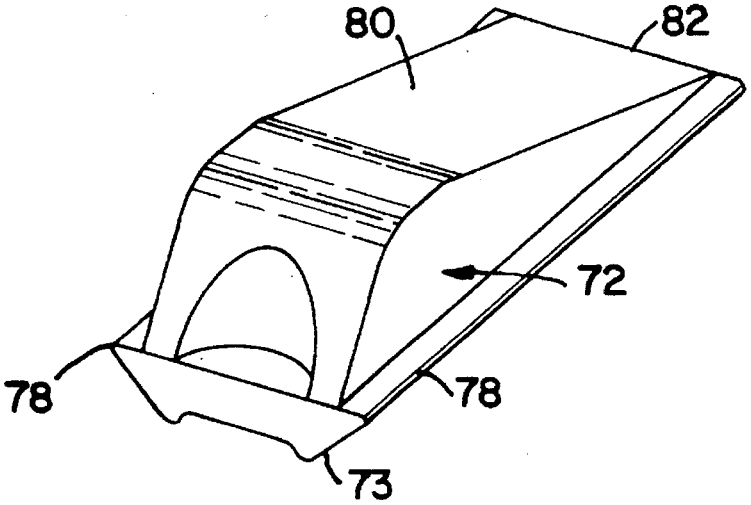
FIG. 7A shows a perspective view of the wash-assist ramp.
Figure 7B:
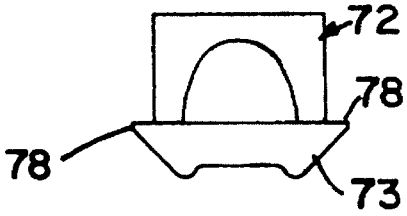
FIG. 7B shows an end view of the wash-assist ramp.
Figure 7C:
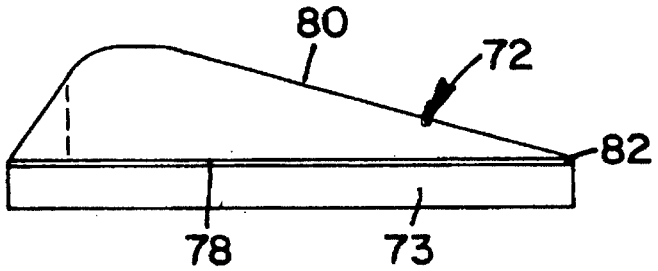
FIG. 7C shows a side view of the wash-assist ramp.

FIG. 7A shows a perspective view of wash-assist ramp 72. FIG. 7B shows an end view of wash-assist ramp 72. FIG. 7C shows a side view of wash-assist ramp 72. Ridges 78, ramp portion 80, and toe 82 are shown in FIGS. 7A and 7C.

Figure 9:
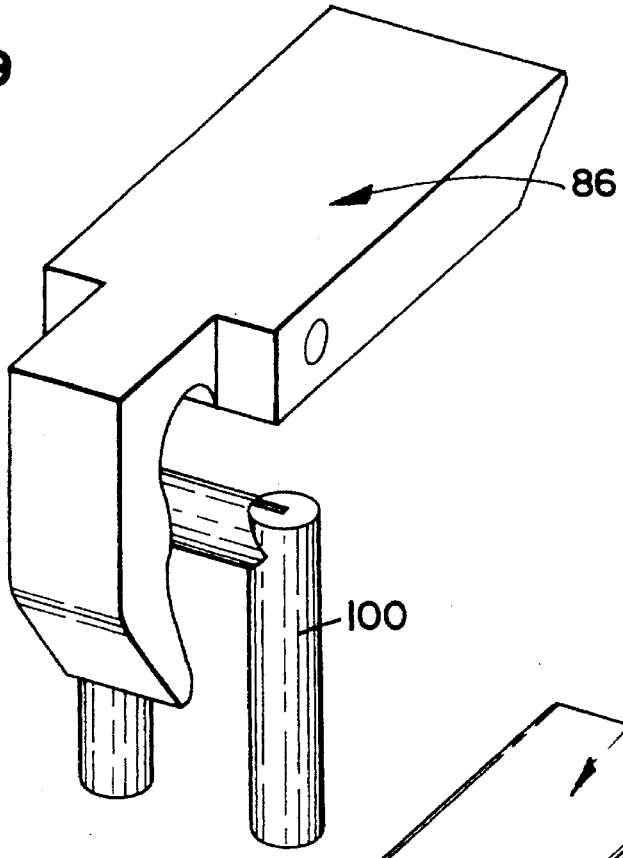
FIG. 9 shows a perspective view of the hooked wash-assist.

FIG. 8 shows a perspective view similar to that shown in FIG. 6, but having a hooked wash-assist 86 instead of wash-assist ramp 72. The hooked wash-assist 86 is rotatably mounted to sides 88 of channel 70 by a pin 90 which extends through hook wash-assist 86 and into sides 88. Hooked wash-assist 86 is preferably located in channel 70 proximate and above lower check rail 35 of lower sash 16 when sash 16 is in the closed position, that is, oppositely disposed sash sides are approximately parallel to frame side members 28. Hooked wash-assist 86 has a lever portion 92. Wash-assist 86 also has a short arm 94 extending from lever position 92 and a guide finger 96 extending from short arm 94. Guide finger 96 has a recess 98. The wash-assist also includes a receiver 100 mounted to side member 28. Receiver 100 has two side members 101 converted to side member 28 and a cross-member 102 operably connected to members 101 opposite side member 28. Side members 101 are separated sufficiently far apart to receive guide finger 96. FIG. 9 shows a perspective view of hooked wash-assist 86 and receiver 100.

FIG. 8 also shows a representative cross section of counterbalance cover 60 having oppositely disposed beads 210 inserted within c-shaped front side 58 of plough 26 in a ball-and-socket like arrangement. Beads 210 are similarly received in front side 59 of plough 27, or front side 61 of plough 25. The ball-and-socket arrangement of beads 210 and c-shaped front sides 58, 59 or 61 provides box-like structural integrity to jamb liners 22, resisting both the depression of the ploughs 25, 26 or 27 toward frame side member 28 and deflection of the ploughs held by one of the counterbalance covers 60 away from each other.

Figure 11:
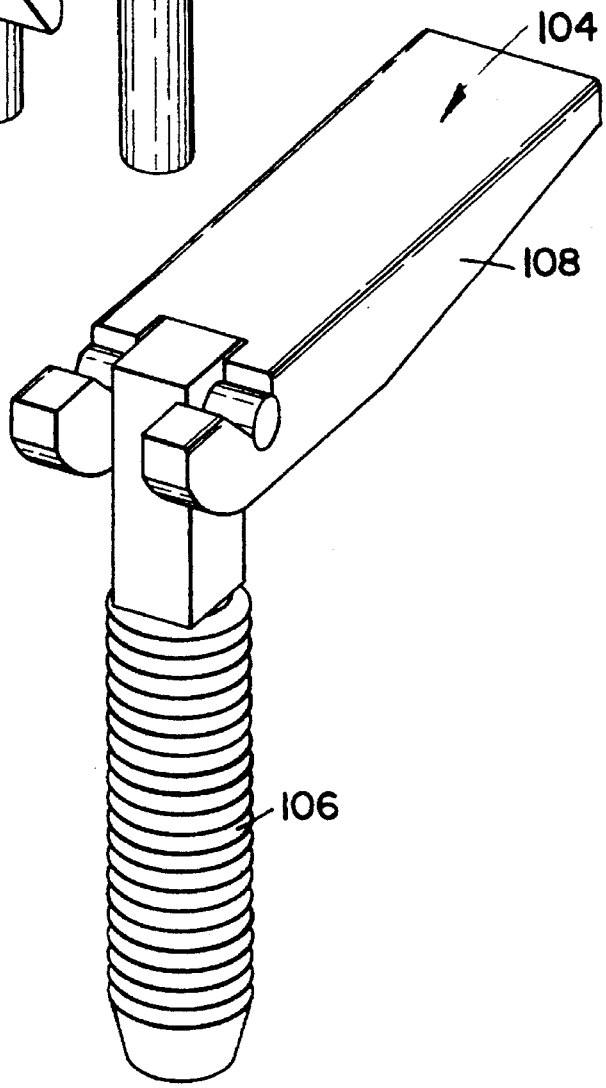
FIG. 11 shows a perspective view of the camming wash-assist.
Figure 10:
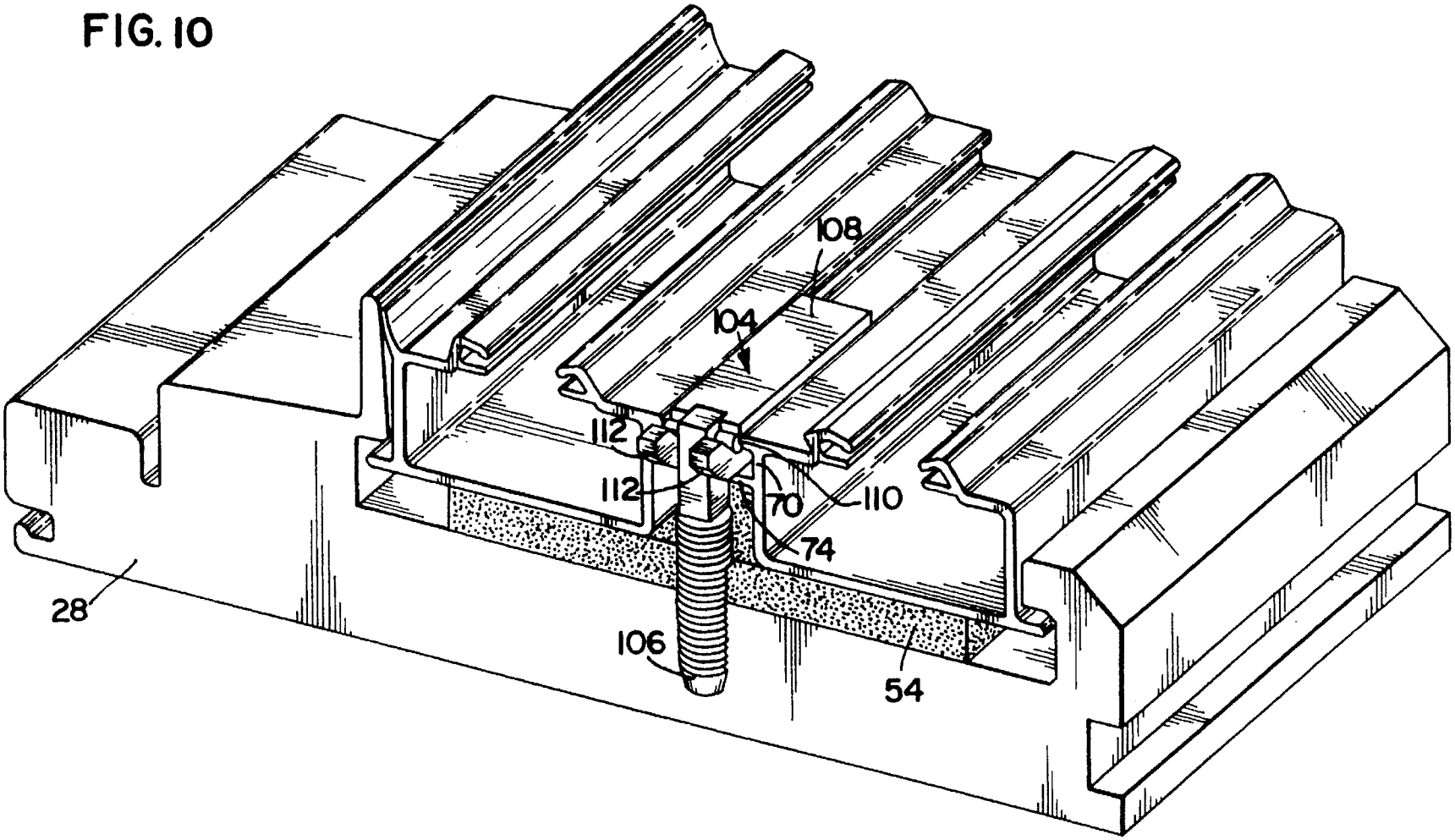
FIG. 10 shows a perspective view of the side member and jamb channel and a camming wash-assist.

FIG. 10 shows a camming wash-assist 104, which is another alternative to the wash-assist ramp 72 and hooked wash-assist 86. Camming wash-assist 104 is preferably located in channel 70 proximate and above lower check rail 35 of lower sash 16 when sash 16 is in the untilted position (the position sash 16 is shown in FIG. 2). Camming wash-assist 104 has an anchor portion 106 and a lever portion 108 having camming surfaces 112. Anchor portion 106 is threaded to side member 28 and lever portion 108 is rotatably attached about pin 110 to anchor portion 106. Anchor portion 106 extends from side 28 through foam spring 54 and through back 74 of channel 70. FIG. 11 shows a perspective view of camming wash-assist 104 having anchor portion 106 and lever portion 108.

Figure 12:
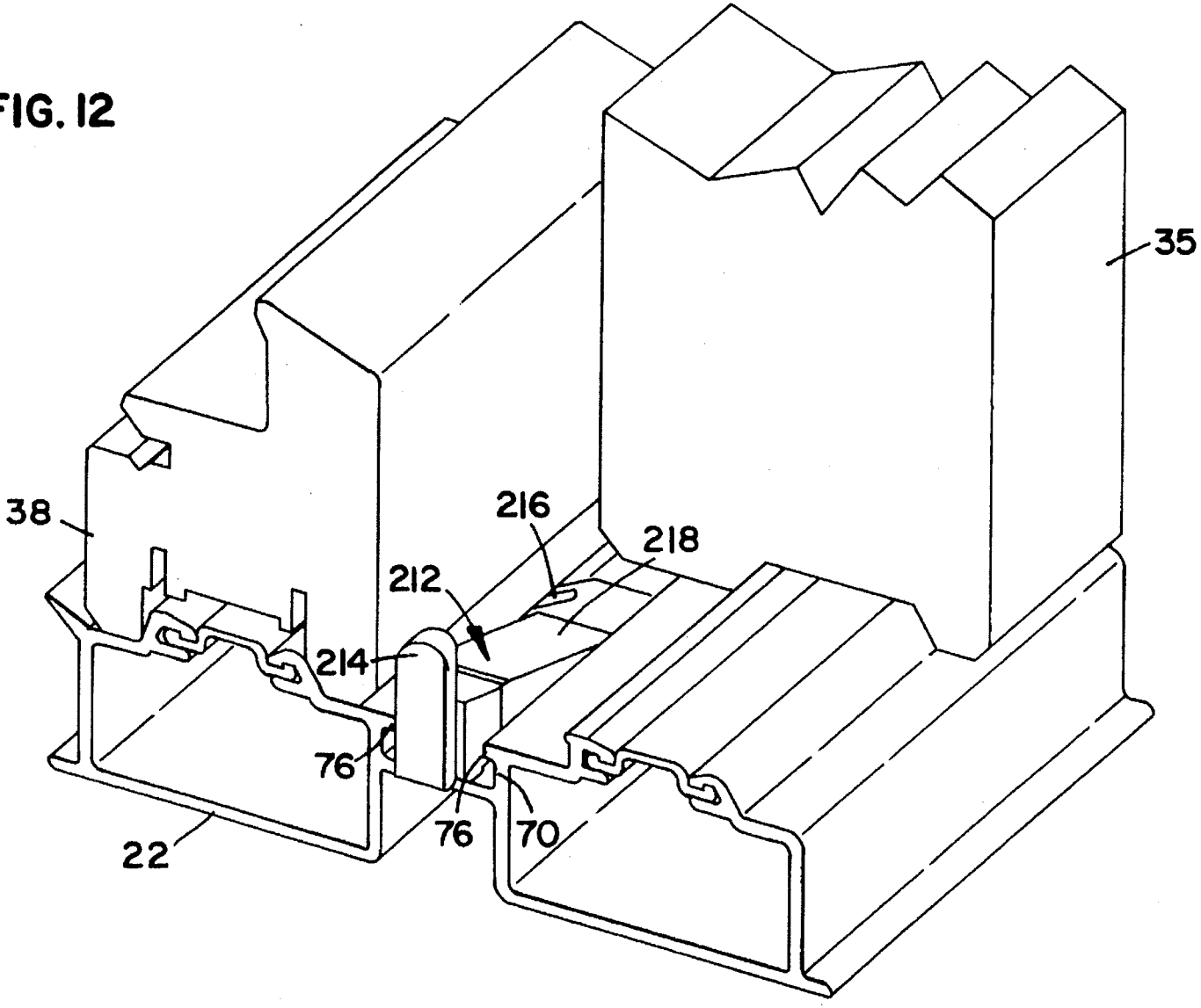
FIG. 12 shows a perspective view of the side member and jamb channel and a biased wash-assist ramp.

FIG. 12 shows a biased wash assist ramp 212. Biased wash assist ramp 212 is an alternative wash assist similar to ramp 72, but biased wash assist ramp 212 includes a finger tab 214 proximate an upper end of ramp 212 and a biasing means for providing positional stability of ramp 212 in channel 70. The biasing means is disposed at the lower end of ramp 212 and including oppositely disposed springs 216. From proximate finger tab 214 to proximate springs 216, the ramp 212 has a sloping portion 218, sloping downward toward springs 216.

Figure 13A:
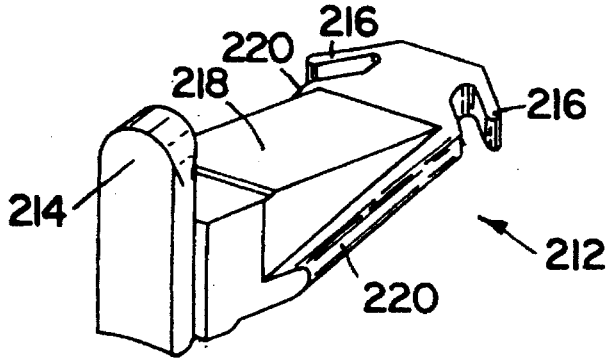
FIG. 13A shows a perspective view of the biased wash-assist ramp.
Figure 13B:
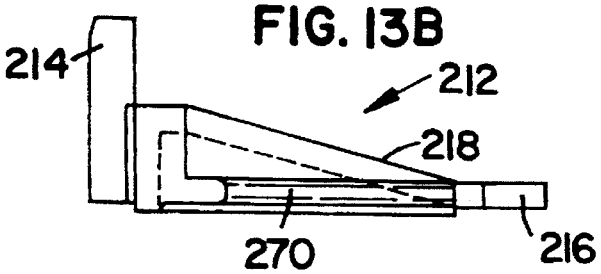
FIG. 13B shows a side view of the biased wash-assist ramp.

FIG. 13A shows a perspective view of biased wash assist ramp 212 having finger tab 214, springs 216, and sloping portion 218. Ramp 212 also has two oppositely disposed ridges 220 that engage with rails 76 of channel 70 to retain biased wash assist ramp 212 within channel 70. FIG. 13B shows a side view of ramp 212.

FIG. 14 shows an exploded view of a sliding locking block, generally referred as 114, and a sash pivot 116. One sliding locking block 114 is slidably mounted within each jamb channel 24. Fastened to lower opposite sides of each sash 14 and 16 is one pivot 116. Pivots 116 are supported for rotation by sliding locking blocks 114. Each sash is tiltable about a longitudinal axis through pivots 116 disposed on opposite sides of sashes 14 and 16.

As shown in FIG. 14, sliding locking block 114 has a housing 118, preferably of rigid plastic. This housing 118 has sliding surfaces 120 with slots 122. The housing 118 has an aperture 124 and a plate groove 126 for attaching a sash pivot retainer spring 128 and a metal plate 130, respectively. A counterbalance spring (not shown) is attached to metal plate 130. The housing 118 has a circular channel 132 for receiving a locking cam 134, having camming surfaces 136. Housing 118 also has a box-like area for receiving a locking spring 138 which has serrated end portions 140. Locking cam 134 has a head 142 which, as known to those skilled in the art, retains spring 138 in the box-like area of housing 118.

Sash pivot retainer spring 128, as shown in FIG. 14, has a hooked first end 144 which is received by aperture 124 to operably connect retainer spring 128 to housing 118. Retainer spring 128 also has free end 146. Retainer spring 128 is preferably spring steel.

The locking cam 134, as shown in FIG. 14, has a sash pivot opening 148 with an open top slot 150. Located proximate a front side of locking cam 134 on opposite sides of sash pivot opening 148, are inwardly disposed cam flanges 152.

FIG. 15 shows a perspective view of the assembled sliding locking block 114 without pivot 116. Retainer spring 128 and plate 130 are shown installed within housing 118. Free end 146 of spring 128 is in a normal position proximate the front side of locking cam 134. Locking cam 134 is shown inserted within circular channel 132 and is retained within locking block 114 by a tab 154. FIG. 15 also shows one serrated end portion 140 of spring 128 retracted within slot 122 in sliding surface 120.

Figure 16:
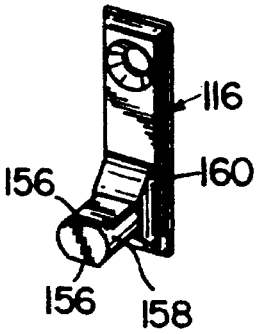
FIG. 16 shows a perspective view of the sash pivot.

FIG. 16 is a front view of pivot 116 having oppositely disposed flanges 156 at one end of an elongated portion 158, and a back 160. Pivots 116 are fastened to the lower opposite sides of sashes 14 and 16 so that the lengthwise axis of back 160 is parallel to the lengthwise axis of each sash side.

Figure 17:
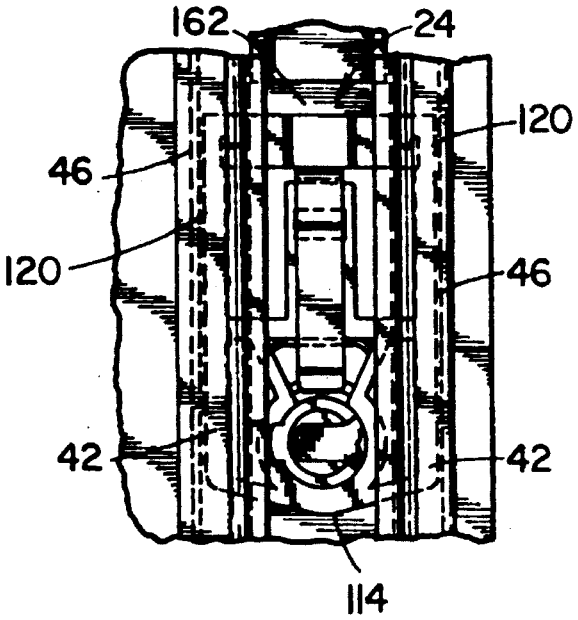
FIG. 17 shows the sliding locking block unlocked in the jamb channel.

FIG. 17 shows sliding locking block 114 inserted in jamb channel 24 having sides 46. Sliding surfaces 120 of sliding locking block 114 are proximate sides 46 of jamb channel 24. Sliding locking block 114 is held within jamb channel 24 by front face 42 having an opening 162.

Figure 21:
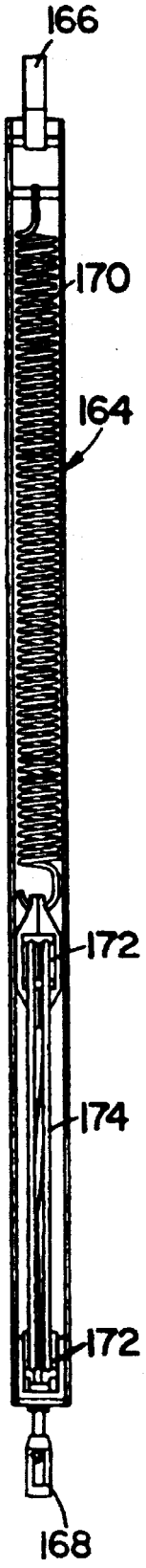
FIG. 21 shows a counterbalance with a counterbalance tab.

FIG. 21 shows a counterbalance, generally referred to as 164. At least one counterbalance 164 is placed in each jamb channel 24 proximate top member 30 of frame 12 by hook 166 proximate one end of counterbalance 164. Proximate the other end of the counterbalance 164 is a tab 168 for connecting the counterbalance 164 to plate 130 of sliding locking block 114. Counterbalance 164 also has a spring 170, pulleys 172, and a cord 174 operably connected as well known in the art.

Figure 22A:
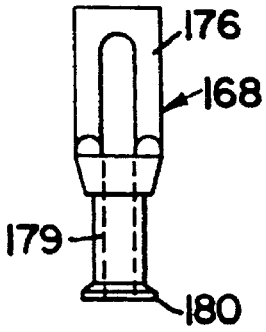
FIG. 22A shows a front view of the counterbalance tab.
Figure 22B:
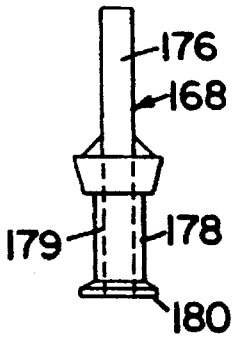
FIG. 22B shows a side view of the counterbalance tab.

Tab 168 includes a means for fastening tab 168 to cord 174. The means for fastening tab 168 to cord 174 includes an elongated loop 176, as shown in FIG. 22A. Tab 168 also includes a cylindrical elongated portion 178 extending from loop portion 176 proximate a first end of elongated portion 178. Extending through cylindrical portion 178 is a bore 179. Cord 174 extends through bore 179 and is knotted within loop portion 176. Connected to the opposite end of elongated portion 178 is circular flange 180. FIG. 22B shows a side view of tab 168 shown in FIG. 22A. The loop portion 176, elongated portion 178, and circular flange 180 are shown.

Figure 23A:
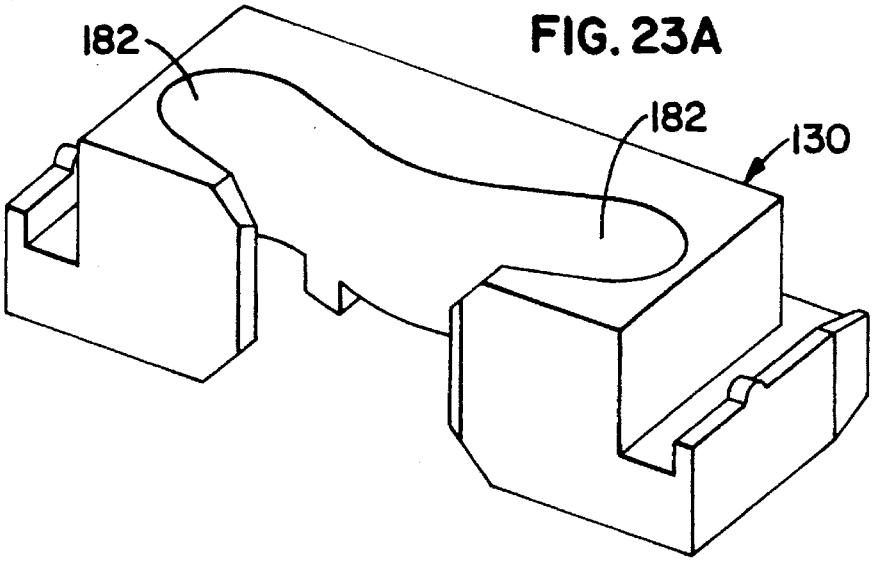
FIG. 23A shows a perspective view of a plate for receiving the counterbalance tab.
Figure 23B:
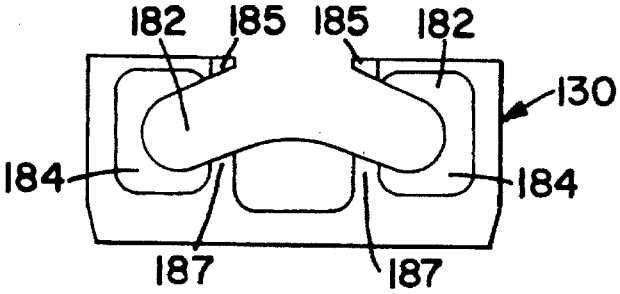
FIG. 23B shows a bottom view of the plate for receiving the counterbalance tab.
Figure 23C:
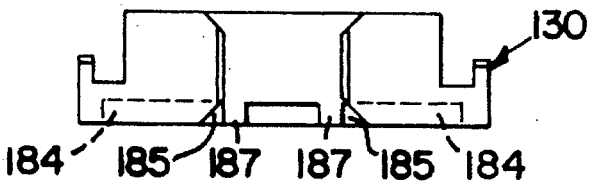
FIG. 23C shows a front view of the plate for receiving the counterbalance tab.

FIG. 23A shows a perspective view of plate 130 having slots 182 for receiving elongated portion 178 of tab 168. Plate 130, as shown in FIG. 23A has two slots 182, each of which are capable of receiving a tab 168. FIG. 23B shows a bottom view of plate 130, as shown in FIG. 23A. Proximate the ends of slots 182 are grooves 184 having ridges 185 and 187 for receiving and retaining flanges 180 of tab 168. FIG. 23C shows a front view of plate 130

Figure 24:
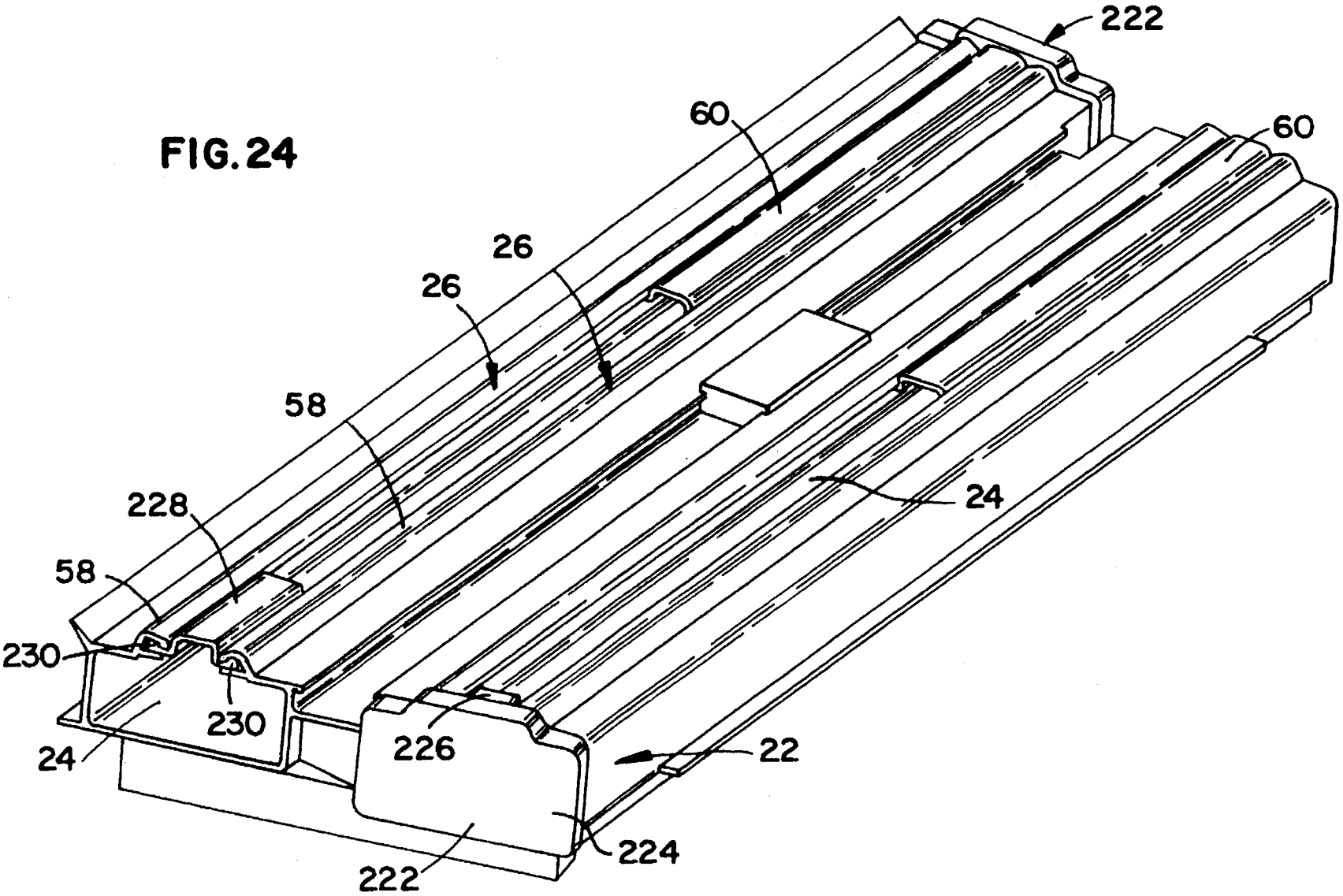
FIG. 24 shows a perspective view of the jamb liner having two end plugs, two balance covers, and outside lower support cover.

FIG. 24 shows a perspective view of jamb liner 22. The length of the jamb liner 22 shown in FIG. 24 is proportionately less than it would be in a standard application, but is shown in this manner for illustrative purposes. The inside side of jamb liner 22 is to the right in the Figure and the outside side is to the left of the Figure. Two end plugs 222 are inserted, one in the top end of jamb channel 24 and another plug is inserted in the lower end of jamb channel 24 proximate the inside. End plug 222 has a conforming wall 224 and a conforming end 226 extending from conforming wall 224. Conforming end 226 is adapted for friction fit connection within jamb channel 24 to seal jamb channels 24.

FIG. 24 also shows a support cover 228 inserted in the c-shaped front sides 58 of ploughs 26 at the lower end of the jamb channel 24 proximate the outside. The cross-section of support cover 228 is preferably the same as the counterbalance cover 60. Support cover 228 has oppositely disposed beads 230 insertable within the c-shaped front side 58. The ball and socket arrangement of beads 230 and c-shaped front sides 58 provide box-like structural integrity to jamb channel 24 of jamb liner 22, resisting both the depression of the ploughs 26 toward frame member 28 and deflection of the ploughs 26 away from each other.

In use, upper and lower sashes 14 and 16, respectively, can be tiled to the inside from an untilted position, where oppositely disposed sides of the sashes are approximately parallel to frame side members 28, to a tilted position where the sash sides are at an angle to frame side members 28. In the tilted position, as shown with respect to lower sash 16 in FIG. 1, both the inside and outside of window pane 20 can be washed from the inside. When in the untilted position, sashes 14 and/or 16 can be slid up or down on jamb liners 22 for venting.

In order to rotate lower sash 16 to the inside, latch 39 must be unfastened and lower sash 16 raised just above stop 29.

Then, for example, wash-assist ramp 72 can be used to retract ploughs 26, and 25 or 27 from sash grooves 64 and 65, that is from a first position A to a second position B, as shown in FIGS. 4 and 5. Hooked wash-assist 86, camming wash-assist 104, or biased wash assist ramp 212, however, can be used instead of wash-assist ramp 72. The detailed operation of these three alternative types of wash-assists will be discussed in detail below. Wash-assists provide predictable control over the movement of the sashes 14 and 16 to enhance safety.

Ploughs 26 and particularly ribbed plough 27 or alternately inverted ploughs 25 hold sashes 14 and 16 in the untilted position when unretracted. Ribbed plough 27 or the alternative inverted plough 25 provide the primary resistance to unwanted tilting in conjunction with inward projecting portion 84 of sash groove 65 for lower sash 16. The engagement between outwardly disposed wedge shaped projection 62 of plough 27 or outwardly disclosed back side 55 of plough 25 with inwardly projecting portion 84 of sash group 65 resists unwanted tilting caused by either wind blowing against the outside or inside of the window 10 or from pulling on lower check rail 35 of sash 16. It has been found that inward projecting portion 84 of sash groove 65 need only be in lower check rail 35 of lower sash 16 to resist unwanted tilting. Additionally, the resistance offered by the inward projection portion 80 engaging with plough 25 or 27 helps prevent unwanted tilting of upper sash 14, even though in the preferred embodiment upper sash 14 has sash groove 64 which does not have an inwardly projecting portion 84.

Once ploughs 26, and 25 or 27 are retracted away from the sash grooves 64, there is less interlocking friction between the ploughs 26, and 25 or 27 and sash groove 64 and 65 to resist the upward pull of counterbalances 164 on sliding locking blocks 114 and lower sash 16. Slight manual pressure on sash 16, however, will prevent it from moving upward until sash 16 is tilted inward, that is rotated about the axis defined by opposite sash pivots 116. During this rotation, serrated end portions 140 of locking spring 138 are extended through slots 122 of sliding locking block 114 into sides 46 of jamb liner 22 to locking sliding block 114.

After lower sash 16 is rotated inward, upper sash 14 may likewise be rotated inward. Before upper sash 14 can be rotated, however, upper sash 14 must be slid downward slightly in order to clear longitudinal flange 31 of top member 30. Then, as with lower sash 16, slight manual pressure will prevent sash 14 from moving upward until it is tilted inward and serrated end portions 104 of locking spring 138 are extended into sides 46 of jamb liner 22.

To return sash 14 or 16 to the untilted position, the wash assist should first be disengaged, returning the ploughs 26, and 25 or 27 to the unretracted position. Then first upper sash 14, followed by lower sash 16, can be rotated back to the untilted position. As sashes 14 and 16 begin to engage with back side 56 of ploughs 26, the ploughs 26, and 25 or 27 will be momentarily retracted until they are seated again within sash grooves 64 and 65. Rib 198 will prevent further outward rotation.

Windows 10, made in accordance with the preferred embodiment of the invention herein, have been tested in accordance with National Wood Window and Door Association (NWWDA) standards for static air infiltration, static water penetration, and static wind load. For each of these tests, the window 10 achieved a rating of grade 40 or better. The window 10 was also tested with latch 39 unfastened and an inwardly directed load of 300 pounds placed on lower check rail 35 of lower sash 16 without causing lower sash 16 to tilt. These features enhance safety by resisting unwanted or unintentional movement of sashes 14 and/or 16.

As noted above, one means for retracting ploughs 26, and 25 or 27 from sash grooves 64 and 65 includes wash-assist ramp 72. While sashes 14 and 16 are in the untilted position, wash-assist ramp 72 is preferably located in channel 70 above lower check rail 35 of lower sash 16. When either lower sash 16 or upper sash 14 are to be tilted, wash-assist ramp 72 is slid down channel 70 and lower sash 16 until it comes in contact with lower check rail 35 of lower sash 16, as shown in FIG. 4.

As can be appreciated by viewing FIG. 4 in conjunction with FIG. 6, when wash-assist ramp 72 is brought into contact with lower check rail 35 of lower sash 16, toe 82 of ramp portion 80 of wash-assist ramp 72 passes between lower check rail 35 and back 74 of channel 70. Then, ramp portion 80 of wash-assist ramp 72 impinges upon lower check rail 35. As wash-assist ramp 72 continues to be pushed further down channel 70, jamb liner 22 is pushed away from sashes 14 and 16 and ploughs 26, and 25 or 27 are retracted from sash grooves 64 and 65. Once ploughs 26, and 25 or 27 are retracted from sash grooves 64 and 65, the engagement between ploughs and grooves will no longer present resistance to tilting of sashes 14 and 16. To reengage ploughs 26, and 25 or 27 when sashes 14 and 16 are in the closed position, wash-assist ramp 72 is merely slid back up channel 70 to a position above lower check rail 35 of lower sash 16. Then spring 54 pushes jamb liner 22 back to its first position.

An alternative to wash-assist ramp 72 is hooked wash-assist 86 which, like wash-assist ramp 72, is used for moving jamb liner 22 between a first position A and a second position B. In order to move jamb liner 22 from the first position A to the second position B using hooked wash-assist 86, hooked wash-assist 86 must be rotated approximately 90° from a first position, as shown in FIG. 8, about pin 90 to a second position where lever portion 92 is approximately 90° to front face 42 of jamb liner 22.

While hooked wash-assist 86 is rotated between its first position and second position, guide finger portion 96 is received between opposite side member 101 and cross member 102 and back side 50 of jamb liner mount 48. As hooked wash-assist 86 approaches its second position, guide finger 96, begins to engage with cross member 102 of receiver 100 to pull jamb liner 22 into the jamb liner's second position. The distance jamb liner 22 moves is controlled by the length of short arm 94 of hooked wash-assist 86. When hooked wash-assist lever 86 is in its second position, cross member 102 of receiver 100 engages with recess 98 to provide positional stability. Rotating hooked wash-assist 86 from its second position to its first position will return jamb liner 22 to its first position, as open cell foam spring 54 pushes against back 40 of jamb liner 22.

Another means for moving jamb liner 22 between its first and second positions includes camming wash-assist 104. In order to move jamb liner 22 from its first position to its second position, lever portion 108 of camming wash-assist 104 must be rotated approximately 90° about pin 110 from a first position, as shown in FIG. 10, to a second position, where lever portion 108 is at approximately 90° to front face 42 of jamb liner 22. As lever portion 108 of camming wash-assist 104 is rotated from its first position to its second position, camming surfaces 112 of lever portion 108 impinge upon back 74 of channel 70, pushing jamb liner 22 from its first position to its second position. To return jamb liner 22 to its first position, lever portion 108 is rotated through 90° about pin 110 to lever portion's 108 first position. Then spring 54 pushes jamb liner 22 back to its first position.

Yet another means for moving jamb liner 22 between its first and second position includes biased wash assist ramp 212. In order to move jamb liner 22 from its first position to its second position, biased wash assist ramp 212 is brought into contact with lower check rail 35 of lower sash 16. As sloping portion 218 of ramp 212 impinges upon lower check rail 35, jamb liner 22 is pushed away from sashes 14 and 16 and ploughs 26, and 25 or 27, are retracted from sash grooves 64 and 65. To return jamb liner 22 to its first position, ramp 212 is slid back up channel 70 to a position above lower check rail 35 of lower sash 16. Then spring 54 pushes jamb liner 22 back to its first position.

As shown in FIG. 2, top edge 188 of check rail liner pad 186 is proximate the top edge 37 of lower check rail 35, while lower sash 16 is in the untilted, non-venting position. Consequently, check rail liner pad 186 will resist unintentional downward motion of wash assist ramp 72 or biased wash assist ramp 212 in channel 70 and, thus, unintentional retraction of jamb liner 22.

Figure 18:
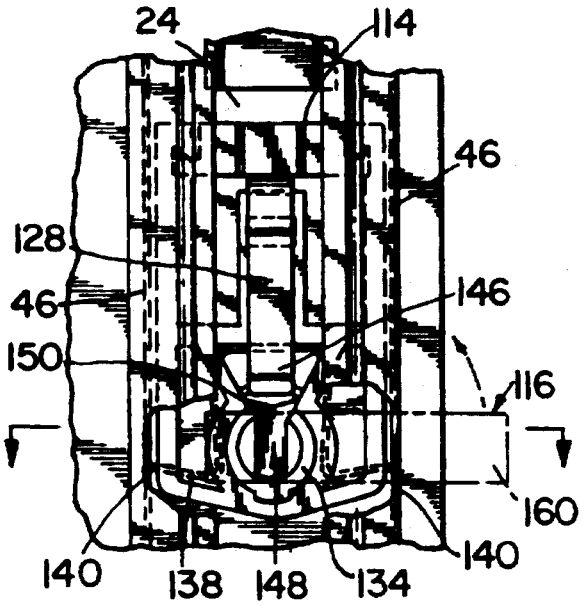
FIG. 18 shows the sliding locking block in the locked position in the jamb channel.

As mentioned above, when sashes 14 or 16 are tilted or rotated inward, serrated end portions 140 of locking spring 138 engage with sides 46 of jamb liner 22 to lock sliding locking block 114 within jamb channels 24. Shown in FIG. 18 are serrated portions 140 of spring 138 engaged with sides 46 to prevent counterbalance 164 from pulling sliding locking block 114 and sash 14 or 16 upward when sash 14 or 16, respectively, are tilted. Thus, positional stability is provided to enhance safety. When sash 14 or 16 and, thus, back 160 of sash pivot 116 is rotated from vertical, locking cam 134 rotates so that camming surfaces 136 force serrated end portions 140 of locking spring 138 out slots 122. In FIG. 18, back 160 is tilted to a horizontal position at approximately 90° to jamb channel 24. This position also corresponds to sash 14 or 16 being tilted at 90° to jamb channel 24.

Also shown in FIG. 18, pivot 116 is operably connected to locking cam 134 by rotating locking cam 134 (with a tool not shown) so that open top slot 150 opens upward beneath retainer spring 128. Pivot 116 is inserted into sash pivot opening 148 by depressing the free end 146 of retainer spring 128 from the normal position inwardly away from the front side of locking cam 134. After pivot 116 is inserted in sash pivot opening 148, the free end of retainer spring 128 moves back to the normal position over open top slot 150. Once retainer spring 128 moves back over open top slot 150, pivot 116 cannot slip out of opening 148. Without retainer spring 128, pivot 116 might slip out of sash pivot opening 148 when sash 14 or 16 is tilted.

Figure 20:
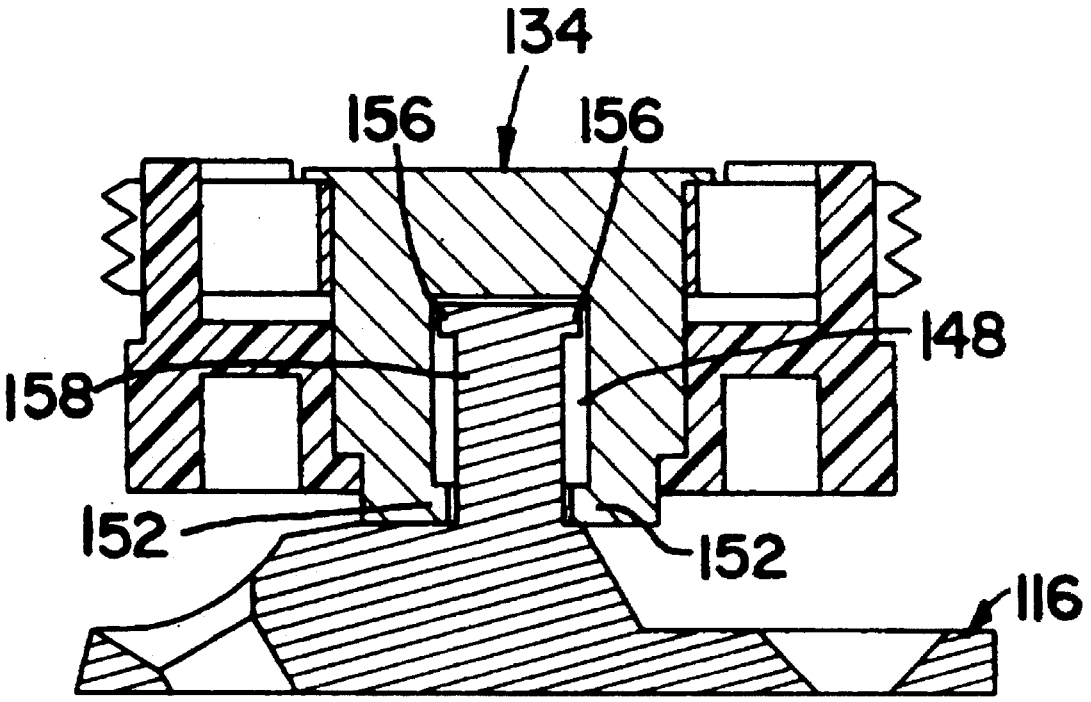
FIG. 20 shows a cross-section of the sliding locking block.

As best shown in FIG. 20, a cross-sectional view of locking cam 134 and pivot 116 taken from FIG. 18, when pivot 116 is inserted into sash pivot opening 148, the elongated portion 158 extends into the opening beyond cam flanges 152. Pivot flanges 156 of pivot 116 are disposed widely enough that when pivot 116 is inserted in this manner, pivot flanges 156 engage with cam flanges 152 so that pivot 116 cannot be pulled out of the pivot opening 148 in a direction approximately parallel to a longitudinal axis of the elongated portion 158. This feature is particularly important during transport and installation of window 10. During transport and installation, side members 28 of frame 12 may bow outwardly away from sashes 14 and/or 16 so that without the engagement of pivot flanges 156 with cam flanges 152, elongated portion 158 of pivot 116 could be pulled out of sash pivot opening 148.

Figure 19:
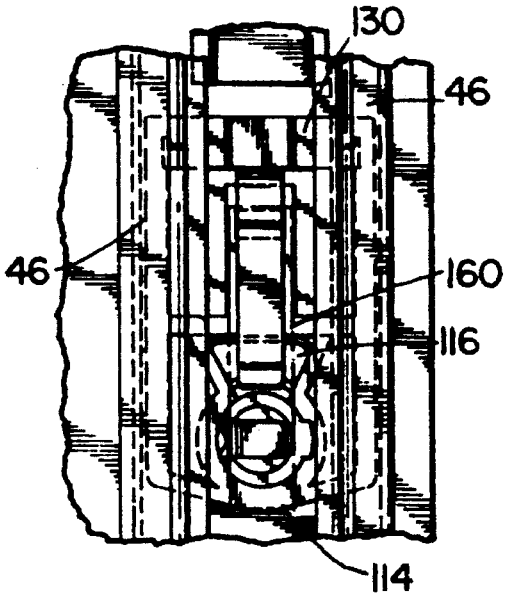
FIG. 19 shows a mirror image of the sliding locking block of FIG. 17.

FIG. 19 shows back 160 of pivot 116 oriented vertically. This position of back 160 corresponds to the untilted position of sash 14 or 16. Serrated end portions 140 of spring 138 are not engaged with sides 46. Sliding locking block 114 and sash 14 or 16 are, thus, free to slide vertically. The counterbalance 164 operably connected to plate 130 assists in sliding locking blocks 114 and sashes 14 or 16 upward.

During assembly of window 10, elongated portion 178 of counterbalance tab 168 is inserted into one of the slots 182 of plate 130 so that tab flange 180 engages with groove 184. The engagement between flanges 180 and groove 184 help to retain elongated portion 178 within slot 182.

As shown in FIGS. 23A, 23B and 23C, plate 130 has two slots 182. Two slots 182 are provided so that one or two counterbalances 164 may be placed in jamb channel 24. Two counterbalances 164 would be used where sash 14 or 16 is particularly heavy. Ridges 185 and 187 of groove 184 retain flange 180 of tab 168.

Although characteristics and advantages, together with details of structure and function, have been described in reference to the preferred embodiment herein, it is understood that the disclosure is illustrative. To that degree, various changes made, especially in matters of shape, size and arrangement, to the full extent extended by the general meaning of the terms in which the appended claims are expressed, are within the principal of the present invention.

What is claimed is:

1. A window having an inside and outside, comprising:

(a) a frame having at least two oppositely disposed side members, a top member and a bottom member;

(b) a jamb liner approximately parallel to and operably connected to at least one side member, the jamb liner having a front face;

(c) a sash, having two opposingly disposed sides, the sash being slidably mounted in the frame and having a tilted position and an untilted position, the two sides of the sash being parallel and proximate opposite frame side members when the sash is in the untilted position;

(d) a plough extending from the face of each jamb liner in the direction of the opposite frame side member, the plough having an inside facing side and an outside facing side, wherein the outside facing side has a projecting portion extending generally in the direction of the outside of the window; and (e) a sash groove in each side of the sash for slidably mounting the sash in the frame by receiving adjacent ploughs when the sash is in the closed position, the groove having a generally inside facing side and a generally outside facing side, wherein the inside facing side has a projecting portion projecting generally in the direction of the inside of the window; so that when the sash is in the untilted position the projecting portion of the plough engages with the projecting portion of the groove to resist inward displacement of the sash.

2. The window in accordance with claim 1, wherein the outside facing side of the plough extends from the face of the jamb liner to an outer end of the plough where the projecting portion is wedge-shaped.

3. The window in accordance with claim 1, wherein the outside facing side of the plough extends from the face of the jamb liner at generally an acute angle to the face of the jamb liner in the direction of the outside to form the projecting portion of the plough.

4. The window in accordance with claim 1, further comprising a sash retaining rib operably connected to the side member for resisting the outward tilting of the sash.

5. The window in accordance with claim 4, further comprising a seal operably connected to the jamb liner proximate the rib, wherein the seal engages with the rib to resist infiltration of air and moisture.

6. A jamb liner operably connected to a window having an inside and an outside, the window also having a frame with at least two oppositely disposed side members, a top member, and a bottom member, the window having a sash, the sash having two opposingly disposed sides, the sash being slidably mounted in the frame and having a tilted position and an untilted position, the two sides of the sash being parallel and proximate opposite frame side members when the sash is in the untilted position, and a sash groove in each side of the sash for slidably mounting the sash in the frame the jamb liner being approximately parallel to and operably connected to at least one side member, the jamb liner comprising:

(a) a front face;

(b) a jamb liner plough extending from the front face of each jamb liner in the direction of the opposite frame side member, the plough having an inside facing side and an outside facing side, wherein the outside facing side has a projecting portion extending generally in the direction of the outside of the window wherein said sash groove receiving adjacent jamb liner ploughs when the sash is in the closed position, the groove having an inwardly projecting portion so that when the sash is in the untilted position the projection portion of the plough engages with the inwardly projecting portion of the groove to resist inward displacement of the sash.

7. The jamb liner in accordance with claim 6, wherein the outside facing side of the plough extends from the face of the jamb liner to an outer end of the plough where the projecting portion is wedge-shaped.

8. The jamb liner in accordance with claim 6, wherein the outside facing side of the plough extensions from the face of the jamb liner are generally at an acute angle to the face of jamb liner in the direction of the outside to form a projecting portion of the plough.

9. A window having an inside and an outside comprising:

(a) a frame having at least two side members, a top member and a bottom member;

(b) a side jamb liner, approximately parallel to and operably connected to each frame side member, the jamb liner having a front face;

(c) a sash slidably mounted in the frame, the sash having a tilted position and an untilted position, the sash having two stiles, each having a top end and a lower end, one stile being parallel and proximate opposite frame side members when the sash is in the untilted position, the sash also having an upper check rail and a bottom rail, wherein the check rail is operably connected to the upper ends of the stiles and bottom rail is operably connected to the lower ends of the stiles;

(d) a plough extending from the face of each jamb liner in the direction of the opposite frame side member, the plough having an inside facing side and an outside facing side, wherein the outside facing side has a projecting portion projecting generally in the direction of the outside of the window; and (e) a sash groove in the stile and check rails for slidably mounting the sash in the frame by receiving adjacent ploughs when the sash is in the closed position, the groove having a generally inside facing side and a generally outside facing side, wherein the inside facing side of the groove in the upper check rail has a projecting portion projecting generally toward the inside of the window; so that when the sash is in the untilted position the projecting portion of the plough engages with the projecting portion of the groove to resist inward displacement of the sash.

10. The window in accordance with claim 9, wherein the outside facing side of the plough extends from the face of the jamb liner to an outer end of the plough having the projecting portion which is rib-shaped.

11. The window in accordance with claim 9, wherein the outside facing side of the plough extends from the face of the jamb liner at generally an acute angle to the face in the direction of the outside to form the projecting portion of the plough.

12. A window, comprising:

(a) a frame having at least two side members, a top member and a bottom member;

(b) a side jamb liner, approximately parallel to and operably connected to each frame side member, the jamb liner having a plough projecting from a front face;

(c) a sash, having at least two stiles, with each stile having a sash groove for receiving the plough of the adjacent jamb liner to slidably mount the sash in the frame;

(d) means for mounting the jamb liner for lateral displacement from a first position wherein the plough is engaged with the sash groove to a second position wherein the plough is at least partially retracted from the groove; and (e) means operably mounted to said jamb liner for laterally displacing the jamb liner from-the first position to the second position.

13. The window in accordance with claim 12, wherein the means for laterally displacing the jamb liner includes a ramp channel formed in the jamb liner and approximately parallel the plough, and a wedge-shaped ramp slidably mounted within the ramp channel; so that the ramp can be slid down the ramp channel to wedge between the jamb liner and the sash pushing the jamb liner from the first position laterally away from the sash to the second position.

14. The window in accordance with claim 12, wherein the means for laterally displacing the jamb liner includes a wash-assist rotatably mounted to the jamb liner having a lever portion and a guide finger, and a receiver mounted to the proximate frame side member, wherein the lever has a first position corresponding to the first position of the jamb liner and the lever has a second engaged position wherein the lever portion is rotated so that the guide finger engages with the receiver to pull the jamb liner away from the sash corresponding to the second jamb liner position.

15. The window in accordance with claim 12, wherein the means for laterally displacing the jamb liner includes a camming lever having a camming surface proximate the face of the jamb liner, the camming lever being rotatably mounted to an anchor portion operably connected to the proximate frame side member, the camming lever having a first position corresponding to the first position of the jamb liner and the camming lever being rotatable to a second position where the camming surface pushes against the face of the jamb liner so that the jamb liner is moved to the second position.

16. A window, comprising:

(a) a jamb liner having a jamb channel the jamb channel having a front face with two jamb channel ploughs having c-shaped front sides disposed toward each other; and (b) a support cover having two oppositely disposed longitudinal beads so that the oppositely disposed beads of the support cover are inserted in the c-shaped front sides disposed toward each other to provide structural support of the jamb liner and channel.

* * * * *

UNITED STATES PATENT AND TRADEMARK OFFICE

CERTIFICATE OF CORRECTION

PATENT NO. : 5,544,450

DATED : Aug. 13, 1996

INVENTOR(S) : Schmidt et al.

It is certified that error appears in the above-indentified patent and that said Letters Patent is hereby corrected as shown below:

Column 13, claim 6, line 14, "projection" should read --projecting--

Signed and Sealed this

Sixth Day of May, 1997

*Attest:*

*Attesting Officer*

BRUCE LEHMAN

*Commissioner of Patents and Trademarks*